United States Patent [19]

Fulcher

[11] 4,447,995

[45] May 15, 1984

[54] BUILDING WITH ILLUMINATED SIGN

[75] Inventor: Junius H. Fulcher, Houston, Tex.

[73] Assignee: Neal J. Mosely, Houston, Tex. ; a part interest

[21] Appl. No.: 370,529

[22] Filed: Apr. 21, 1982

[51] Int. Cl.[3] ..... G09F 7/18

[52] U.S. Cl. ..... 52/38; 52/105; 40/447

[58] Field of Search ..... 40/450, 451, 452, 447; 340/815; 52/235, 38, 105, 104, 171

[56] References Cited

U.S. PATENT DOCUMENTS

| | | | |
|---|---|---|---|
| 1,676,498 | 7/1928 | Lawrence | 52/38 |
| 3,206,901 | 9/1965 | Bakke | 52/235 |
| 3,570,158 | 3/1971 | Hackett | 40/452 |
| 3,685,240 | 8/1972 | Oscari | 52/235 |

FOREIGN PATENT DOCUMENTS

| | | | |
|---|---|---|---|
| 1460598 | 10/1966 | France | 40/450 |

*Primary Examiner*—Henry E. Raduazo
*Attorney, Agent, or Firm*—Neal J. Mosely

[57] ABSTRACT

An office building has a glass paneled exterior with transparent window panels extending from floor to ceiling of each story and a horizontal row of panels of translucent glass positioned adjacent the floor or the ceiling of a single story building or between the top portion of one story and the bottom portion of the next story in a multi-story building. An illuminated sign is provided comprising a plurality of electrically illuminated sign modules aligned linearly behind some of the translucent glass panels, which comprise a plurality of individual lights, selectively illuminable in the form of any one of a plurality of selected alphanumeric characters or symbols. The individual lights, when energized, provide light of an intensity sufficient to be seen outside the translucent glass panels but are invisible from the outside when deenergized. Control switches, etc., are provided for selectively energizing the lights on selected ones of the sign modules. The lights may be bulbs or tubes providing light in straight segments, arranged in a square pattern with intermediate subdividing and diagonally extending segments, or may be bulbs providing light in individual points, arranged in a plurality of rows of linearly spaced lights in a square or rectangular pattern which, when illuminated in selected combinations, can produce any character or symbol. Separate switches may be provided for energizing the lights in a selected pattern, and to select the module on which said selected pattern is to appear in a selected or moving sequence.

8 Claims, 5 Drawing Figures

BUILDING WITH ILLUMINATED SIGN

BACKGROUND OF THE INVENTION

1. Field of the Invention

This invention relates to new and useful improvements in office buildings and more particularly to all glass exterior buildings having a novel arrangement of illuminated signs.

2. Description of the Prior Art

Lawrence U.S. Pat. No. 1,676,498 discloses a building with a removable front having cut-out portions through which electric lights can be seen providing a fixed sign.

Barns U.S. Pat. No. 1,796,233 discloses an airport hanger or like building with reflective letters or symbols on the roof thereof.

McCarty, Jr. U.S. Pat. No. 2,617,220 discloses an airplane having illuminated panels on the underside of its wings with electrically illuminated alphanumeric modules for communication, advertising, etc.

Buchert U.S. Pat. No. 3,963,326 discloses a data display panel with alphanumeric illuminated modules.

SUMMARY OF THE INVENTION

One of the objects of this invention is to provide a new and improved office building structure with illuminated signs showing on the exterior of the building only when illuminated.

Another object of this invention is to provide a new and improved office building structure with illuminated signs, positioned inside the building and showing on the exterior of the building only when illuminated.

Another object of this invention is to provide an improved office building of the type having a glass paneled exterior, including some translucent panels with illuminated sign modules positioned to be seen only when illuminated.

Other objects of the invention will become apparent from time to time throughout this specification and claims as hereinafter related.

These and other objects of the invention are accomplished by an office building which has a glass paneled exterior with transparent window panels extending from floor to ceiling of each story and a horizontal row of panels of translucent glass positioned adjacent the floor or the ceiling of a single story building or between the top portion of one story and the bottom portion of the next story in a multi-story building.

An illuminated sign is provided comprising a plurality of electrically illuminated sign modules aligned linearly behind some of the translucent glass panels, which comprise a plurality of individual lights, selectively illuminable in the form of any one of a plurality of selected alphanumeric characters.

The individual lights, when energized, provide light of an intensity sufficient to be seen outside the translucent glass panels but are substantially invisible from the outside when deenergized. Control switches, etc., are provided for selectively energizing the lights on selected ones of the sign modules.

The lights may be bulbs or tubes providing light in straight segments, arranged in a square pattern with intermediate subdividing and diagonally extending segments, or may be bulbs providing light in individual points, arranged in a plurality of rows of linearly spaced lights in a square or rectangular pattern which, when illuminated in selected combinations, can produce any desired symbol or character.

Separate switches may be provided for energizing the lights in a selected pattern, and to select the module on which said selected pattern is to appear in a selected or moving sequence.

DESCRIPTION OF THE PREFERRED EMBODIMENTS

In many areas, there are zoning or deed restrictions which prevent the installation of exterior signs on office buildings and particularly signs which are positioned high on a building or which have moving characters or symbols. A new type of building, which has come into prominence, particularly in warm or sunny areas, is the all glass exterior building.

In many such buildings, some or all of the glass panels are of a translucent glass (or equivalent plastic sheet). These panels will be referred to a translucent both where there is a hazy, subdued transmission of light and where there is a clear transmission of light, i.e. is transparent, but of a very low intensity. The term translucent, as used herein, includes tinted glass, black glass, one-way mirror glass, etc.

These all glass exterior buildings, with at least some translucent glass panels offer an opportunity to provide illuminated signs in office buildings which would otherwise be objectionable or illegal.

Figure 1:
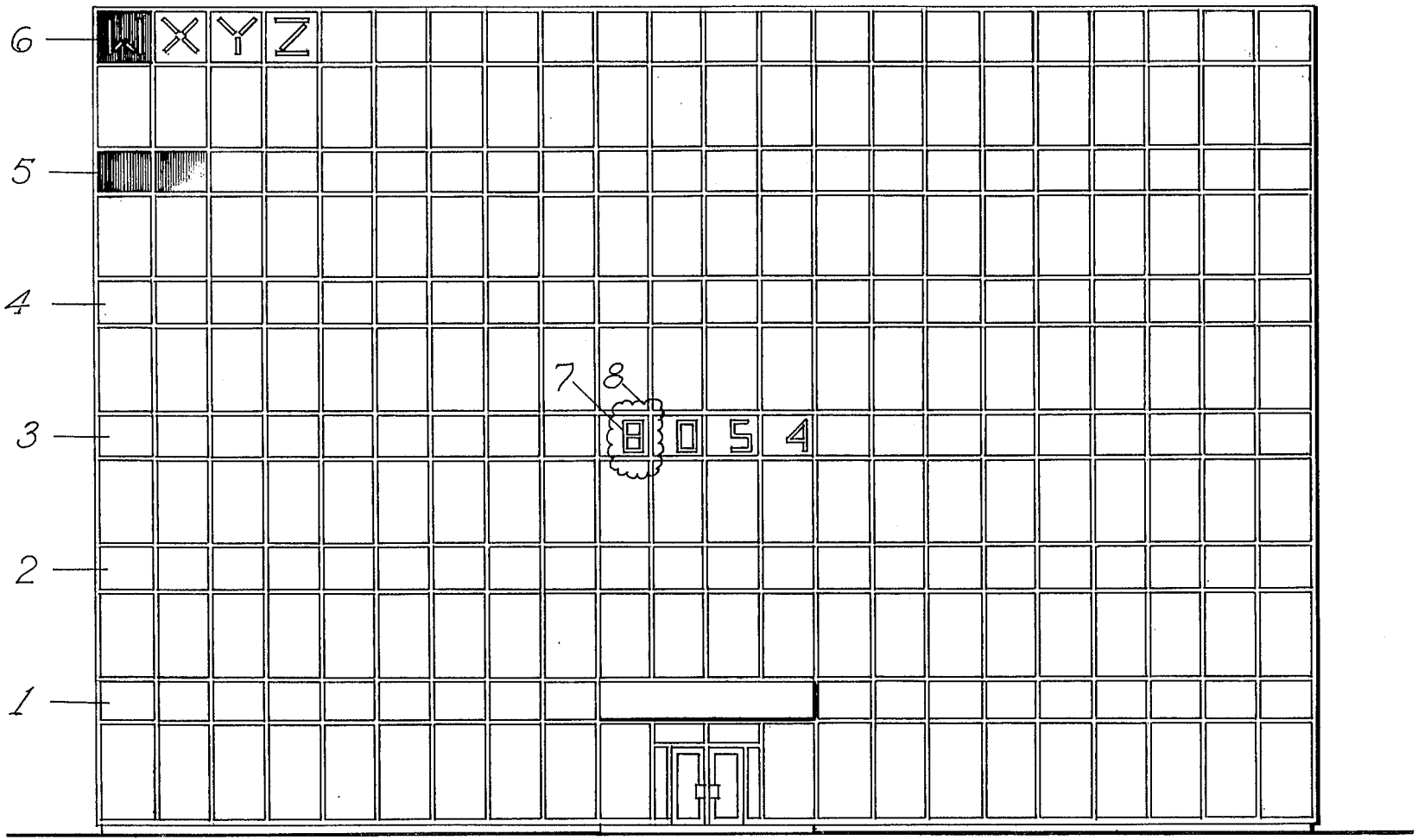
FIG. 1 is a view in front elevation of a glass paneled office building including an illuminated sign which is a preferred embodiment of this invention.
Figure 2:
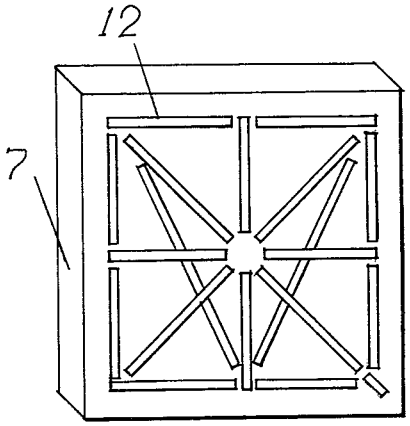
FIG. 2 is a detail isometric view of a sign module used in the building combination shown in FIG. 1.

In FIG. 1, there is shown an all glass exterior building 10 of modern design. Building 10 has a plurality of floors or stories with large glass window panels 11 extending from floor to ceiling of each story. The dividing area between the top of one story and the bottom of the next (or the top or bottom portion of a one story building) is made of a translucent glass which will transmit substantially reduce intensity light. These panels are of a glass which will be referred to as translucent glass.

In the building 10, there are shown rows of translucent glass panels designated 1, 2, 3, 4 and 5 between successive stories of the building, and row 6 located at the top of the top floor of the building. These rows of glass panels are generally in front of the areas between the floors which are accessible for utilities and the like. In some buildings, some or all of the window panels may be of translucent glass instead of fully transparent glass.

In rows 3 and 6 there are provided illuminated signs positioned behind the translucent glass panels. These signs comprise a plurality of electrically illuminated sign modules 7 aligned linearly behind selected ones of the translucent glass panels. The sign modules are shown indirectly by the presence of the alphanumeric characters, or other symbols, of the sign and directly at the portion 8 broken out for showing the module.

Each of the sign modules 7 includes lighting means selectively illuminable in the form of any one of a plurality of selected symbols or alphanumeric characters. The lighting means, when energized, provides light of an intensity sufficient to be seen outside the translucent glass panels but is not visible from the outside when deenergized.

The lighting means on each module 7 comprises a plurality of separately energizable electric lights positioned in an array such that the illumination of selected lights will produce a selected alphanumeric character or other symbol. The lights on each module are bulbs or tubes 12 providing light in straight segments, arranged in a square pattern with intermediate subdividing and diagonally extending segments which, when illuminated in selected combinations, can produce any alphanumeric character or other symbol.

Figure 4:
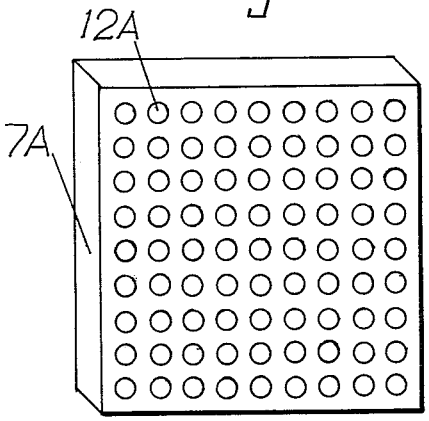
FIG. 4 is a detail isometric view of another embodiment of the sign module used in the building combination as shown in FIG. 1.

In FIG. 4, there is shown an alternate embodiment of the sign module in which the lights are bulbs 12*a* providing light in individual points, arranged in a plurality of rows of linearly spaced lights in a square or rectangular pattern which, when illuminated in selected combinations, can produce any alphanumeric character or other symbol.

Figure 3:
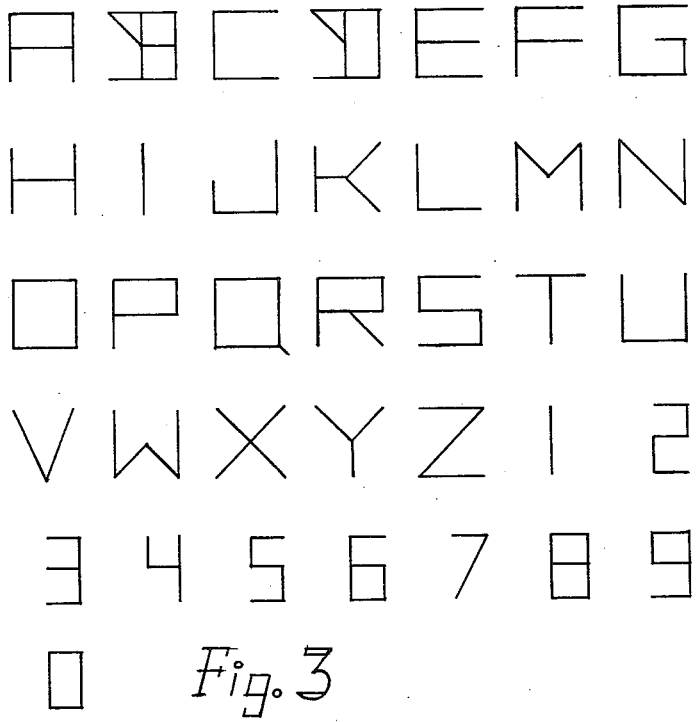
FIG. 3 is a plan view of a plurality of alphanumeric characters which may be produced by the sign modules as shown in FIG. 2.

The building/sign combination includes means for selectively energizing the lights 12 or 12*a* to produce selected alphanumeric characters or symbols on selected ones of the sign modules 7 or 7*a*. This selected energizing means is operable to energize separate lights in a predetermined pattern and may include separate means for energizing the lights in a selected pattern and means to select the module 7 or 7*a* on which the selected pattern is to appear, or in a selected or moving sequence. Examples of an entire alphabet of letter produced by sign module 7 are shown in FIG. 3. All of the numerals from 0 to 9 are similarly produced.

Figure 5:
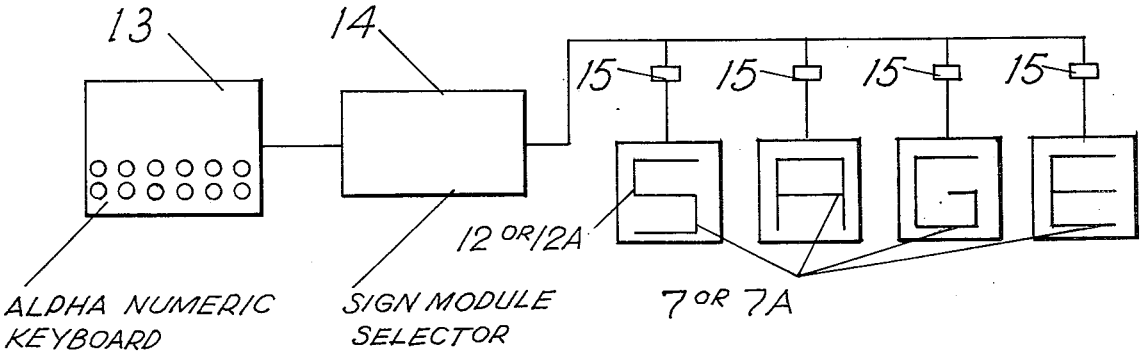
FIG. 5 is a diagrammatic or schematic view of a control system for the sign modules in the building combination shown in FIG. 1.

In FIG. 5, there is shown a schematic diagram of the sign modules and selected energizing means therefor. A plurality of the sign modules 7 or 7*a* are shown as in row 3 of the building 11. The input to the modules 7 or 7*a* is provided through an alphanumeric keyboard 13 to a sign module selector switch 14 which directs the signal to the selected module. Selector switch 14 may, if desired, be a sequencing switch which will direct the keyboard signal to the various modules in sequence and thus produce a moving sign. The keyboard signal is directed by the selector 14 to a multiple relay or microprocessor 15 which translates the signal to energize the selected lights 12 or 12*a* to produce the desired alphanumeric characters or other symbols.

OPERATION AND USE

The signs formed of separate modules 7 or 7*a* positioned behind the translucent glass panels may be located at any desired place on the building behind such panels. The modules 7 or 7*a*, and the lights 12 or 12*a*, are not visible through the translucent glass panels when not energized. When the modules 7 or 7*a* have their lights energized through keyboard 13, selector 14 and relays or microprocessors 15, the sign is visible from outside the building. This system provides an illuminated sign for the building without violating regulations prohibiting exterior signs and which is aesthetic in appearance.

While this invention has been described fully and completely with emphasis upon a number of preferred embodiments, it should be understood that within the scope of the appended claims the invention may be practiced otherwise than as specifically described herein.

I claim:

1. An office building provided with interiorly located illuminated signs visible when energized and invisible when deenergized, for construction in an area where exterior signs are not permitted legally, said office building having a glass paneled exterior with transparent or translucent window panels extending from floor to ceiling of each story and a horizontal row of panels of translucent glass positioned adjacent the floor or the ceiling of a single story building or between the top portion of one story and the bottom portion of the next story in a multi-story building, an illuminated sign positioned within said building comprising a plurality of electrically illuminated sign modules aligned linearly, closely adjacent to and behind selected ones of said translucent glass panels adjacent the floor or the ceiling of a single story building or between the top portion of one story and the bottom portion of the next story in a multi-story building, each of said modules comprising lighting means selectively energized for illumination in the form of any one of a plurality of selected symbols, said lighting means, when energized, providing light of an intensity sufficient to be seen outside said translucent glass panels but being substantially invisible from the outside when deenergized, and means for selectively energizing said lighting means to produce selected symbols on selected ones of said sign modules.

2. A building and sign combination according to claim 1 in which said lighting means on each module comprises a plurality of separately energizable electric lights positioned in an array, closely behind said panels, such that the illumination of selected lights will produce a selected alphanumeric symbol, and said selected energizing means is operable to energize said separate lights in a predetermined pattern.

3. A building and sign combination according to claim 2 in which said lights on each module are bulbs or tubes providing light in straight segments, arranged in a square pattern with intermediate subdividing and diagonally extending segments which, when illuminated in selected combinations, can produce any alphanumeric character.

4. A building and sign combination according to claim 2 in which said lights on each module are bulbs providing light in individual points, arranged closely behind said panels in a plurality of rows of linearly spaced lights in as square or rectangular pattern which, when illuminated in selected combinations, can produce any alphanumeric character.

5. A building and sign combination according to claim 2, 3 or 4 in which said selective energizing means includes separate means for energizing said lighting means or said lights in a selected pattern, and means to select the module on which said selected pattern is to appear.

6. A building and sign combination according to claim 2, 3 or 4 in which said selective energizing means includes separate means for energizing said lighting means or said lights in a selected pattern, and means to select the module on which said selected pattern is to appear in a selected or moving sequence.

7. A building and sign combination according to claim 1 in which said window panels are of translucent glass.

8. A building and sign combination according to claim 7 in which said sign modules are positioned behind translucent glass panels aligned horizontally of said building between two adjacent stories thereof.

* * * * *